US006179000B1

(12) United States Patent
Zdobinski et al.

(10) Patent No.: US 6,179,000 B1
(45) Date of Patent: Jan. 30, 2001

(54) THREE-WAY VALVE

(75) Inventors: David B. Zdobinski, Rockaway; Christopher E. Epler, Whitehouse Station, both of NJ (US)

(73) Assignee: Automatic Switch Company, Florham Park, NJ (US)

( * ) Notice: Under 35 U.S.C. 154(b), the term of this patent shall be extended for 0 days.

(21) Appl. No.: 09/439,271

(22) Filed: Nov. 12, 1999

(51) Int. Cl.[7] ..... F15B 13/043
(52) U.S. Cl. ..... 137/596.15; 91/454; 137/596.16
(58) Field of Search ..... 91/454; 137/596.15, 137/596.16

(56) References Cited

U.S. PATENT DOCUMENTS 2,881,801 * 4/1959 McCormick ..... 137/270.5

* cited by examiner

*Primary Examiner*—Gerald A. Michalsky
(74) *Attorney, Agent, or Firm*—Levine & Mandelbaum

(57) ABSTRACT

A three-way valve for controlling the application of air to a pneumatically controllable device has a pressure chamber for pressurizing a work chamber to which the device is connectable and an exhaust chamber for expelling air from the work chamber. Unidirectional flow means prevents air in the work chamber from entering the space behind a valve member controlling the flow of air from the pressure chamber to the work chamber for avoiding valve lockup.

5 Claims, 7 Drawing Sheets

THREE-WAY VALVE

BACKGROUND OF THE INVENTION

This invention relates to a solenoid-operated three-way valve for electrically controlling the application of pressurized air to a pneumatically operated tool, control valve, or other device. More specifically, this invention improves upon the pilot operated three-way valves described in U.S. Pat. No. 2,881,801, the disclosure of which is incorporated herein by reference.

Although the three-way valve of U.S. Pat. No. 2,881,801 performs its function admirably, its performance can be hampered under particular operating conditions. For example, if the input pressure should decrease rapidly while the valve is energized and open to apply pressurized air to a device, an instantaneous pressure differential can close and lock the valve in the closed state even after the valve is deenergized.

SUMMARY OF THE INVENTION

The aforementioned problems of the prior art are overcome by the instant invention which provides for a three-way valve which has a working chamber with an inlet port, an exhaust port and a work port, a pressure chamber with an inlet port adapted to be connected to a source of pressure, and an outlet port, and a main pressure valve seat circumscribing a main pressure valve opening at an interface between the work chamber inlet port and main pressure valve outlet port. A main pressure valve member is movable in response to differences in force exerted on a front side thereof by the pressures in the work chamber and pressure chamber, and on a rear side thereof by the pressure in a space behind the main pressure valve member for seating on, and unseating from, the main pressure valve seat.

The three-way valve also has an exhaust chamber with an inlet port, and an outlet port adapted to open into the ambient atmosphere, and a main exhaust valve seat circumscribing a main exhaust valve opening at an interface between the work chamber outlet port and main exhaust valve inlet port. A main exhaust valve member is movable in response to differences in force exerted on a front side thereof by the pressure in the work chamber and in the exhaust chamber, and on a rear side thereof by the pressure in a space behind the main exhaust valve member for seating on and unseating from the main exhaust valve seat.

One bleed passageway extends from the pressure chamber to the space behind the main pressure valve member. Another bleed passageway extends from the work chamber to the space behind the main exhaust valve member.

A pilot valve has a pilot pressure valve seat which circumscribes a pilot pressure valve opening at an interface between the space behind the main pressure valve member and the space behind the main exhaust valve member, and a pilot exhaust valve seat which circumscribes a pilot exhaust valve opening at an interface between the space behind the main exhaust valve member and the ambient atmosphere.

The pilot valve has an off state in which a pilot valve member seals the pilot pressure valve opening while exposing the exhaust pressure valve opening, and an on state in which a pilot valve member seals the exhaust pressure valve opening while exposing the pilot pressure valve opening.

A unidirectional flow device, e.g., a check valve, is mounted between the working chamber and the space behind the main exhaust valve member for preventing flow of fluid from the working chamber to the space behind the main exhaust valve member through the exhaust bleed passageway which would lock up the three-way valve, but permitting flow of fluid from the space behind the main exhaust valve member to the working chamber through the exhaust bleed passageway as is necessary for the three-way valve to function.

It is therefore an object of the invention to provide a three-way valve which is resistant to lock-up due upon loss of inlet pressure.

Another object of the invention is to provide a three-way valve with a unidirectional flow means between its work chamber and the space behind its exhaust valve member.

Still another object of the invention is to provide a three-way valve member with a check valve in its exhaust bleed port.

Other and further objects of the invention will be apparent from the following drawings and description of a preferred embodiment of the invention in which like reference numerals are used to indicate like parts in the various views.

DESCRIPTION OF THE PREFERRED EMBODIMENT

Figure 1:
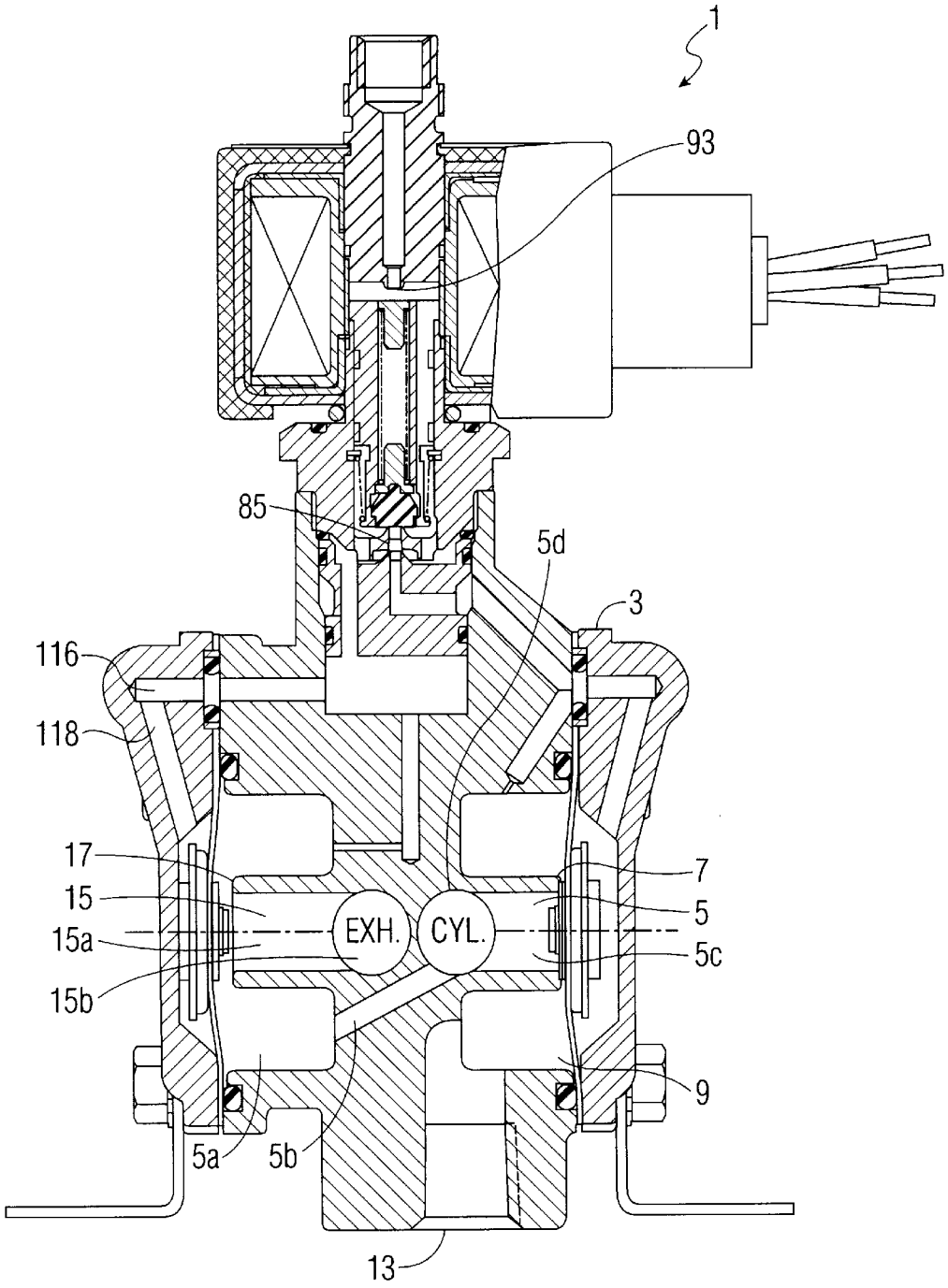
FIG. 1 PRIOR ART
FIG. 1 is a schematic elevation view of a three way valve in accordance with the prior art in a first stage of operation.

Referring now to FIGS. 1–4 of the drawings, there is shown a three-way valve 1 having a body 3 with a working chamber 5 having a circular region 5*a*, a cylindrical region 5*c* with an end circumscribed by a main pressure valve seat 7, a channel 5*b* extending from the circular region 5*a* to the cylindrical region 5*c*, and an outlet port 5*d* adapted to be connected to a pneumatically operated device leading from the cylindrical region 5*c*. The working chamber 5 is selectively pressurized to operate the device connected to the outlet port 5*d*.

A pressure inlet port 13, adapted to be connected to a source of air pressure (not shown), is in communication with a circular pressure chamber 9 which surrounds the cylindrical region 5*c* of working chamber 5. Evacuation of the working chamber 5 is principally through an exhaust chamber 15 within the body 3. The exhaust chamber 15 has a cylindrical region 15*a* which is surrounded by the circular region 5*a* of the working chamber 5. The cylindrical region 15*a* has one end circumscribed by an exhaust valve seat 17 and an opposite end which is in communication with an exhaust port 15*b* which is open to the ambient atmosphere.

Application of pressurized air from the pressure chamber 9 to the working chamber 5 is controlled by a main pressure valve 25 having a pressure valve member 29 centrally mounted on a circular diaphragm 33, the circumference which is captured between members 16 and 18 of the valve body 3.

Expulsion of pressurized air from the working chamber 5 to the ambient atmosphere is controlled by an exhaust valve 39 having a main exhaust valve member 45 centrally mounted on a circular diaphragm 53, the circumference of which is captured between members 16 and 27 of the valve body 3.

Opening and closing of the pressure valve 25 and exhaust valve 39 is controlled by shuttling an armature 57 of a solenoid 69, which armature 57 serves as a pilot valve member, between a pilot pressure valve seat 61 and a pilot exhaust valve seat 65. A narrow bleed passageway 73 in body part 16 restricts the flow of pressurized air from the pressure chamber 9 into a passageway 77. The passageway 77 leads to a passageway 81 which communicates with a pilot pressure valve opening 85 surrounded by the pilot pressure valve seat 61, and with interconnected passageways 79*a* and 79*b* which lead to a space behind the main pressure valve member 29.

A narrow bleed passageway 105 in body part 16 restricts the flow of pressurized air from the working chamber 5 into a series of passageways 106, 108, 110, and 112 which communicate with a contiguous space 114 surrounding the pilot pressure valve opening 85, pilot valve member 57 and pilot exhaust valve opening 93. Conduit branches 116 and 118 extend between the passageway 108 and the space behind exhaust valve member 45.

The pilot pressure valve opening 85 is sealed when the pilot valve member 57 is in its deenergized (lowermost) bottom position as shown in FIG. 1. At the same time, a pilot exhaust valve opening 93, surrounded by the pilot exhaust valve seat 65, is uncovered.

In the position, shown in FIG. 1, the main pressure valve member 29 is seated on the main pressure valve seat 7 to prevent communication between the pressure chamber 9 and working chamber 5. In the position shown in FIG. 2, the main pressure valve member 29 is displaced from the main pressure valve seat 7 thereby allowing the pressure chamber 9 and working chamber 5 to communicate so that pressurized air in the pressure chamber 9 can enter the working chamber 5.

The exhaust main valve 39 controls communication between the working chamber 5 and the exhaust chamber 15. As shown in FIG. 1, the exhaust main valve member 45 is in an open position, displaced from the main exhaust valve seat 17 thereby permitting pressurized air in the working chamber 5 to escape to the exhaust chamber 15 and into the ambient atmosphere. In its closed position, shown in FIG. 2, the exhaust main valve member 45 is seated on the main exhaust valve seat 17 for blocking air flow between the working chamber 5 and exhaust chamber 15 thereby preventing escape of air from the working chamber 5 to the exhaust chamber 15.

FIG. 1 illustrates an initial state of the three-way valve 1 of the invention wherein the solenoid 69 is not energized and the pilot valve member 57 is seated on the pilot pressure valve seat 61 thereby exposing the pilot exhaust opening 93 to the ambient atmosphere. Pressurized air at the inlet port 13 has filled the pressure chamber 9 and, through the pressure bleed opening 73, the space behind the pressure valve member 29. Because the pilot pressure opening 85 is sealed by the pilot valve member 57, air cannot escape from the pressure chamber 9 or the space behind the pressure valve member 29.

With the exhaust valve 39 now open, the pressure in working chamber 5 is at ambient, hence the pressure in the space behind the main pressure valve member 29 is greater than the net opposing pressure on the main pressure valve member 29 and the main pressure valve 25 is closed. As long as the solenoid 69 is deenergized and a steady pressure, greater than ambient is maintained at the inlet port 13, the main pressure valve 25 is intended to remain closed for preventing air in the pressure chamber 9 from entering the working chamber 5.

At the same time, the space behind the exhaust valve member 45 is at ambient pressure due to communication with the ambient atmosphere through passageways 118, 116, 108, and the space 114. Therefore, any pressurized air entering in the working chamber 5 is vented to the ambient environment through the exhaust chamber 15. Hence, while the solenoid 69 is deenergized and a steady pressure, greater than ambient, is maintained at the pressure inlet port 13, the exhaust pressure valve 39 is intended to remain open for exhausting air in the working chamber 5 to the exhaust chamber 15 and into the ambient atmosphere.

Figure 2:
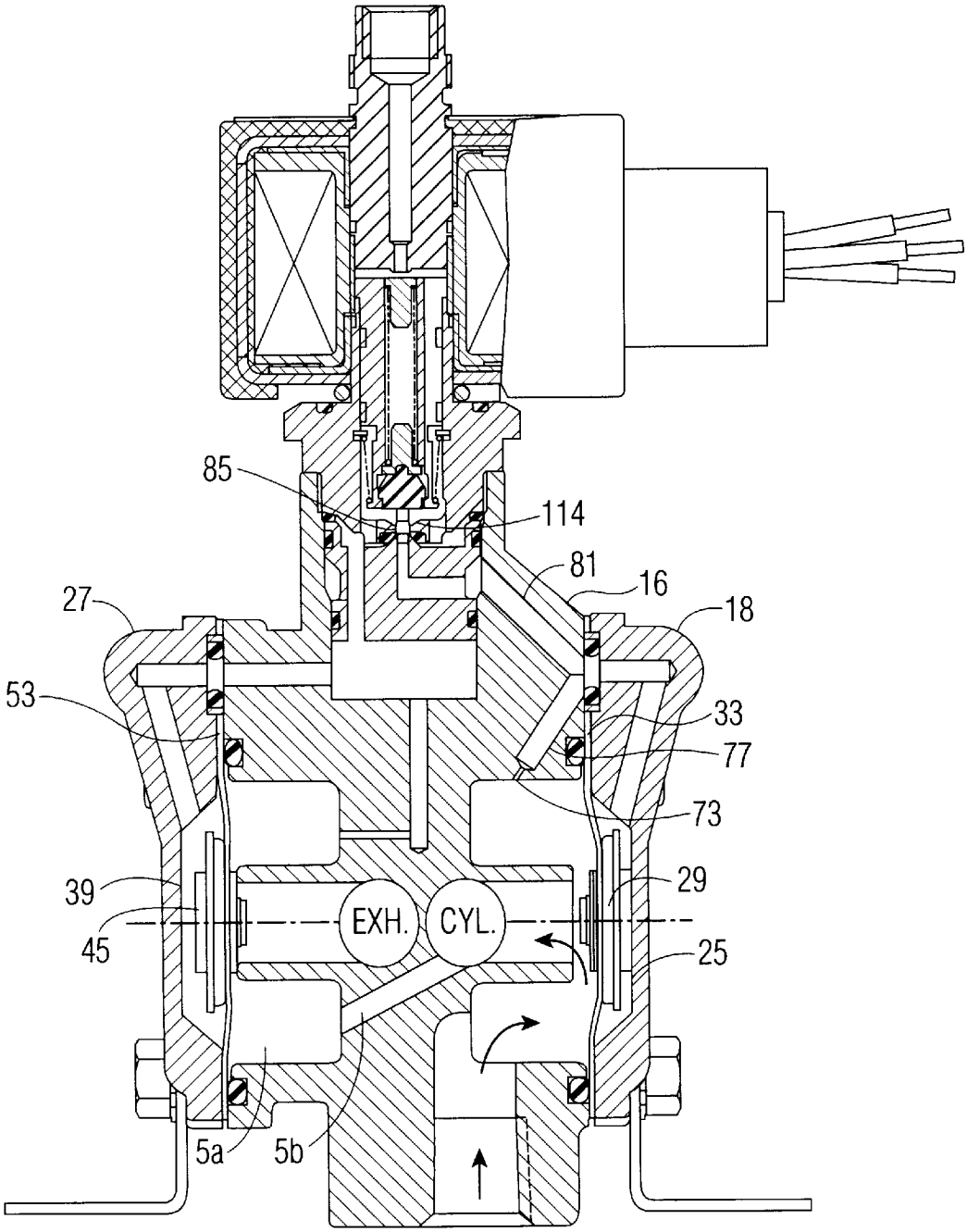
FIG. 2 PRIOR ART
FIG. 2 is a schematic elevation view of a three way valve in accordance with the prior art in a second stage of operation.

When the solenoid 69 is energized, its electromagnet 113 raises the pilot valve member 57 to the position shown in FIG. 2, with the pilot exhaust valve seat 65 engaged by the pilot valve member 57 and the pilot exhaust valve opening 93 sealed. In this position, the pilot valve member 57 is raised off of the pilot pressure valve seat 61. Air trapped behind the main pressure valve member 29 is then able to escape through conduits 79*b*, 79*a*, 81, 112, 110, 116, and 118 to the space behind the exhaust valve member 45 thereby forcing the exhaust valve member 45 onto the exhaust valve seat 17 for closing the exhaust valve 39, and, at a slower rate, through the exhaust bleed opening 105 into the working chamber 5. Air in the pressure chamber 9 also escapes to the space behind the exhaust valve member 45, but at a much slower rate than the air behind the pressure valve member 29 do to the restrictive size of the pressure bleed opening 73. The resulting reduction in pressure behind the pressure valve member 57 below the pressure in the working chamber 5 forces the pressure valve member 29 away from the pressure valve seat 7 thereby opening the main pressure valve and allowing the pressurized air in the pressure inlet port 13 to enter working chamber 5. Hence, while the solenoid 69 is energized and a steady pressure, greater than ambient is maintained at the pressure inlet port 13, the main pressure valve 25 is intended to remain open to admission of pressurized air from the pressure chamber 9 to the working chamber 5 until equilibrium between the pressures in the pressure chamber 9 and working chamber 5 occurs.

With the pilot pressure valve opening 85 now exposed and the pilot exhaust valve opening 93 sealed, the space behind the main exhaust valve member 45 is at the inlet pressure urging the main exhaust valve member 45 toward the exhaust main valve seat 17. Although pressure urging the main exhaust valve member 45 away from the main valve seat 7 is applied from within the circular region 5*a* of the working chamber 5, the exhaust chamber 15 which the central portion of the main exhaust valve member 45 faces, is at ambient pressure resulting in a net force which closes the main exhaust valve 39. Hence, while the solenoid 69 is energized and a steady pressure, greater than ambient is maintained at the pressure inlet port 13, the main exhaust valve 39 is intended to remain closed to prevent air in the working chamber 5 from escaping into the ambient atmosphere. In order to prevent a pressure drop across the pilot valve opening 85 from restricting flow from the pressure valve bleed opening 73 to the exhaust valve bleed passageway 105, the pilot pressure opening 63 and pilot exhaust opening 93 are of the same size. In order to cause the exhaust main valve 39 to open when the solenoid 69 is deenergized and the pilot valve opening 85 is sealed as shown in FIG. 1, the pilot exhaust bleed opening 105 is smaller than the pilot exhaust opening 93.

To close the main exhaust valve 39, that is to cause the main exhaust valve member 45 to move to the right in the views shown in the drawings, the exhaust bleed opening 105 must provide sufficient restriction so that back pressure is developed in the space behind the main exhaust valve member 45 when the solenoid 69 is energized and the pilot valve member 57 is raised to the position shown in FIG. 2.

Figure 3:
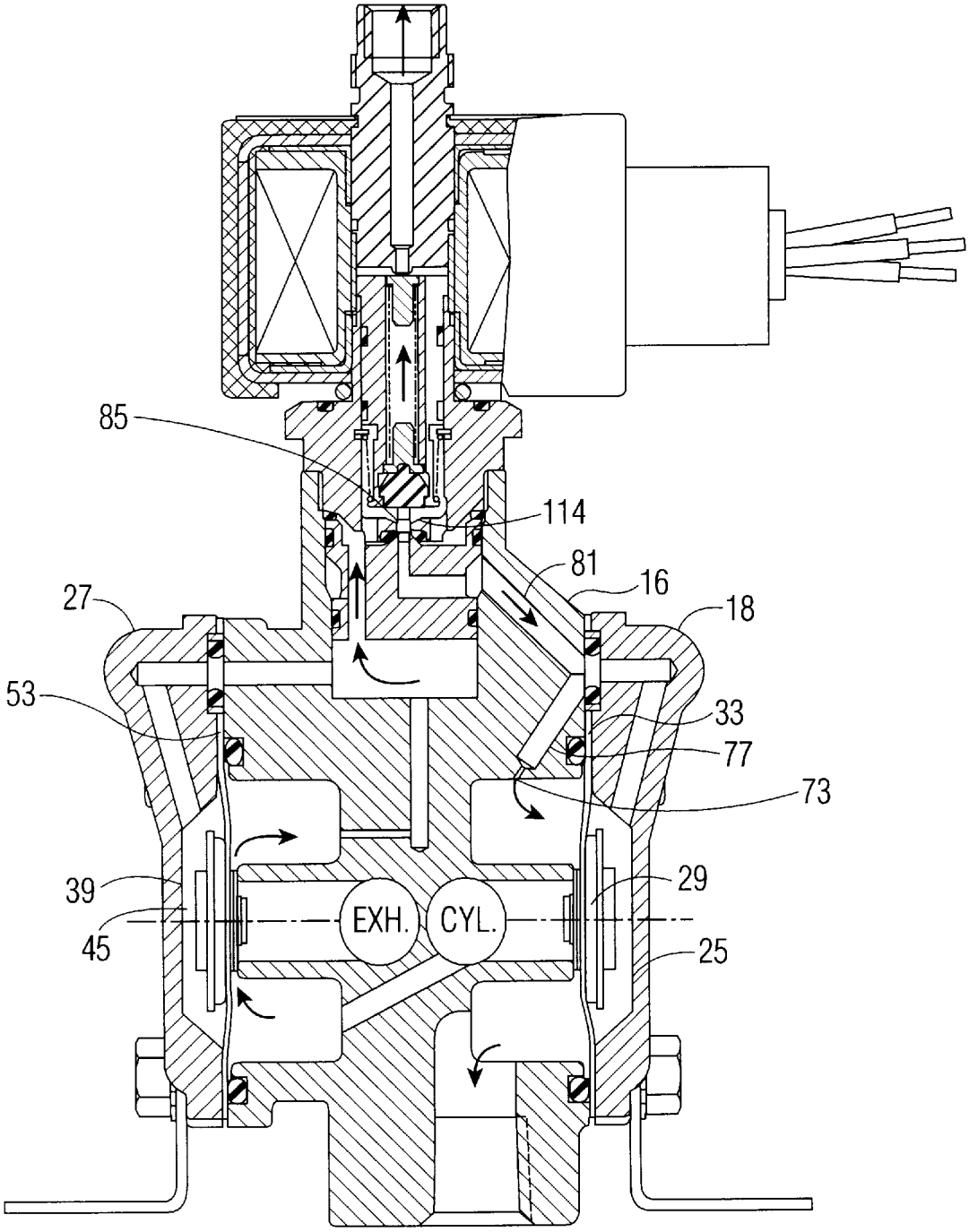
FIG. 3 PRIOR ART
FIG. 3 is a schematic elevation view of a three way valve in accordance with the prior art in a third stage of operation.

When the solenoid 69 is initially energized, the main pressure valve 25 opens as described above. Once the demand for pressurized air made by the device connected to the working port 5*d* ceases, and the pressures in the pressure chamber 9 and working chamber 5 reach equilibrium, the pressure diaphragm 33 returns to its rest position against the main pressure valve seat 7 as shown in FIG. 3.

If the pressure at the inlet port 13 should thereafter decrease rapidly, an instantaneous pressure drop in the pressure chamber 9 will create a pressure differential across the pressure valve member 29 due to the back flow of air from the working chamber 5 to the space behind the pressure valve member 29. That is, while the solenoid 69 is energized, back flow of air from the working chamber 5 to the space behind the pressure valve member 29, i.e., through exhaust valve bleed opening 105, and passageways 106, 108, 110, 81, 79*a,* and 79*b* can hamper valve performance.

This pressure differential can force the main pressure valve member 29 against the main valve seat 7, resulting in a valve lock-up condition which is maintained while the solenoid 69 is energized because pressure enters the chamber behind the pressure diaphragm 33 more readily than it can flow through the pressure bleed opening 73, and the pressure in the working chamber 5 can only be relieved at a very slow rate through the exhaust bleed opening 105.

Figure 4:
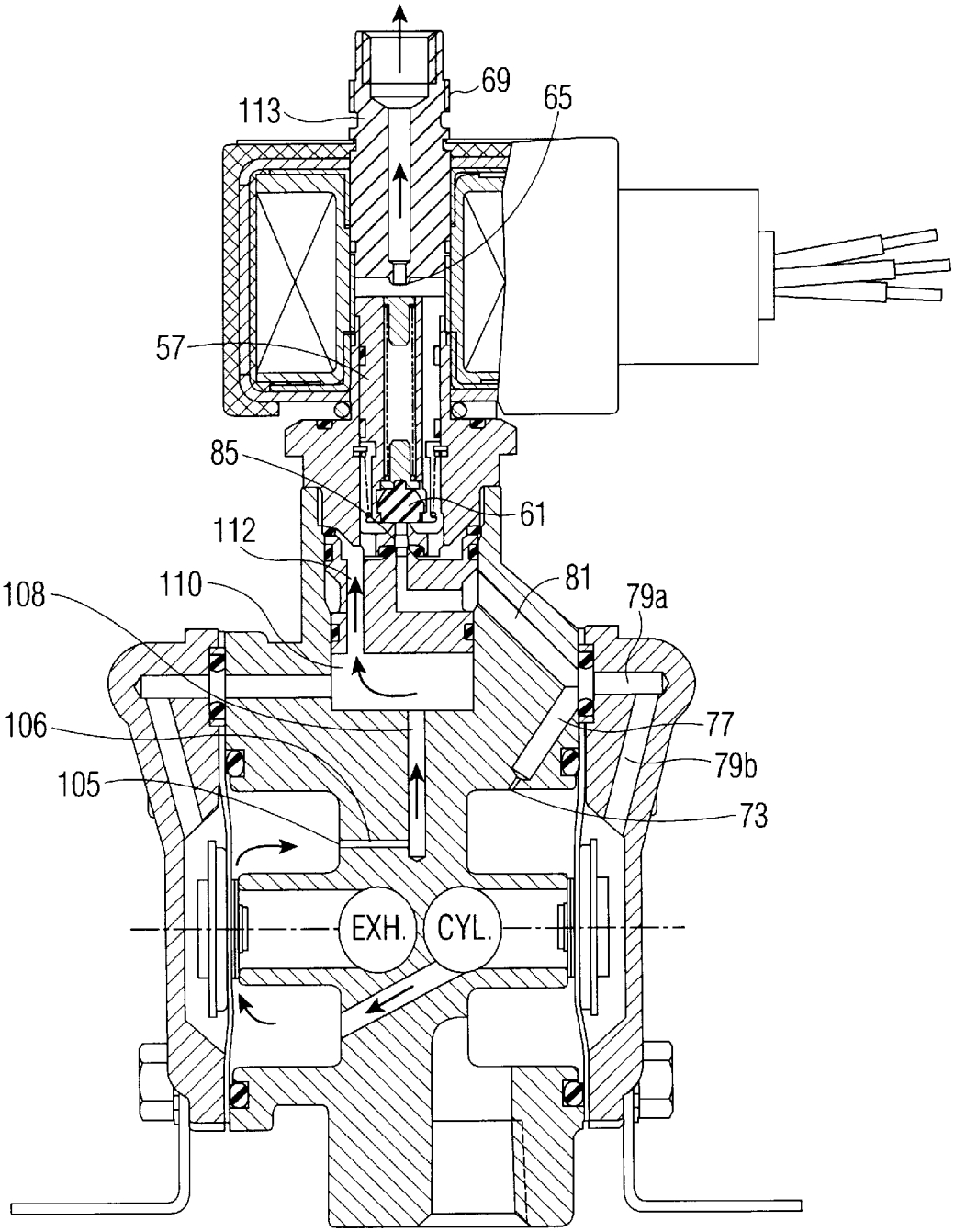
FIG. 4 PRIOR ART
FIG. 4 is a schematic elevation view of a three way valve in accordance with the prior art in a fourth stage of operation.

As shown in FIG. 4, when the solenoid 69 is deenergized, evacuation of air from the working chamber 5 through the exhaust valve bleed opening 105, and passageways 108, 110, and the space surrounding pilot member 57 can maintain a pressure differential across the main exhaust valve member 45 which prevents the main exhaust valve 39 from opening, again resulting in valve lock-up.

Figure 5:
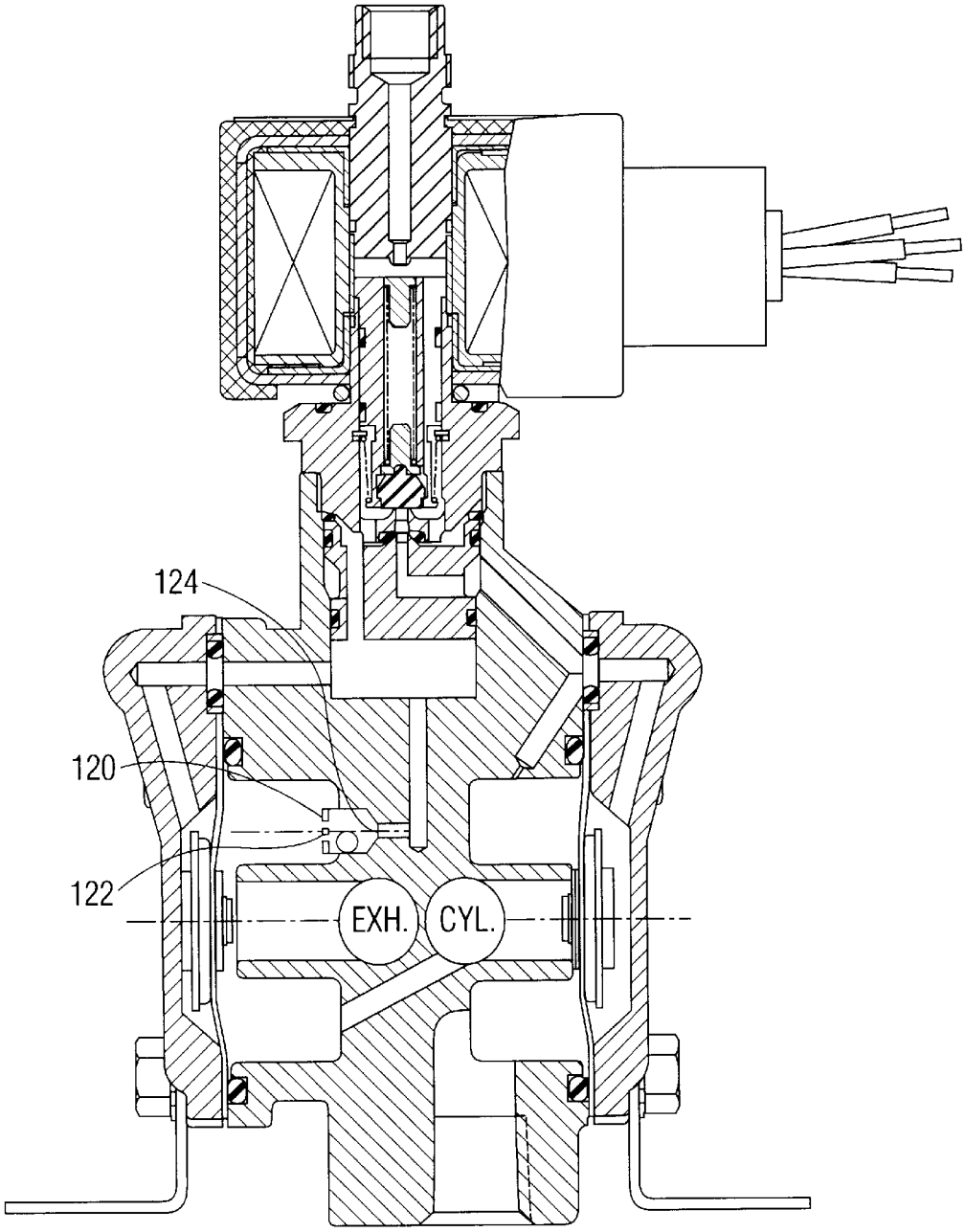
FIG. 5 is a schematic elevation view of a three way valve in accordance with the preferred embodiment of the invention in a first stage of operation.
Figure 6:
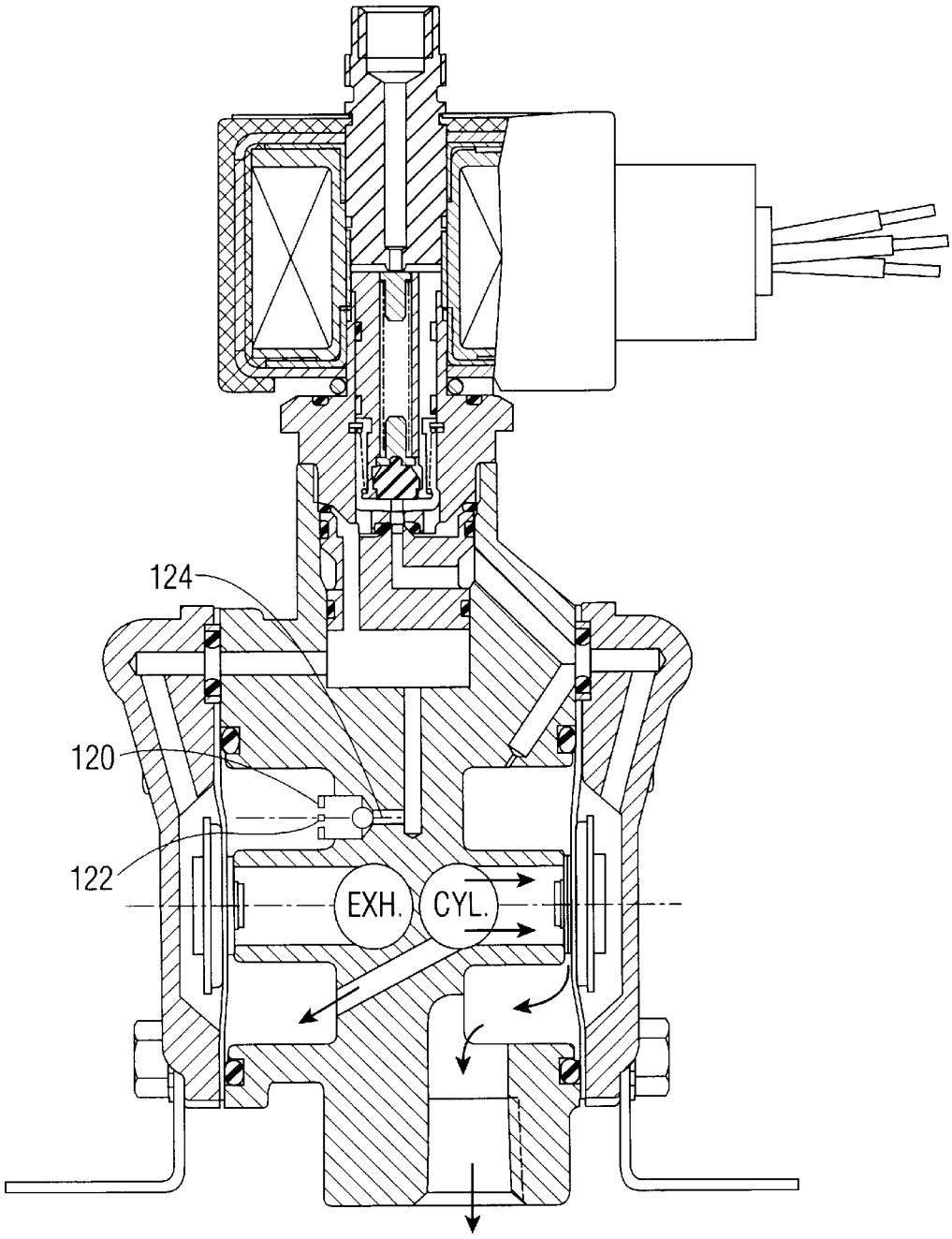
FIG. 6 is a schematic elevation view of a three way valve in accordance with the preferred embodiment of the invention in a second stage of operation.
Figure 7:
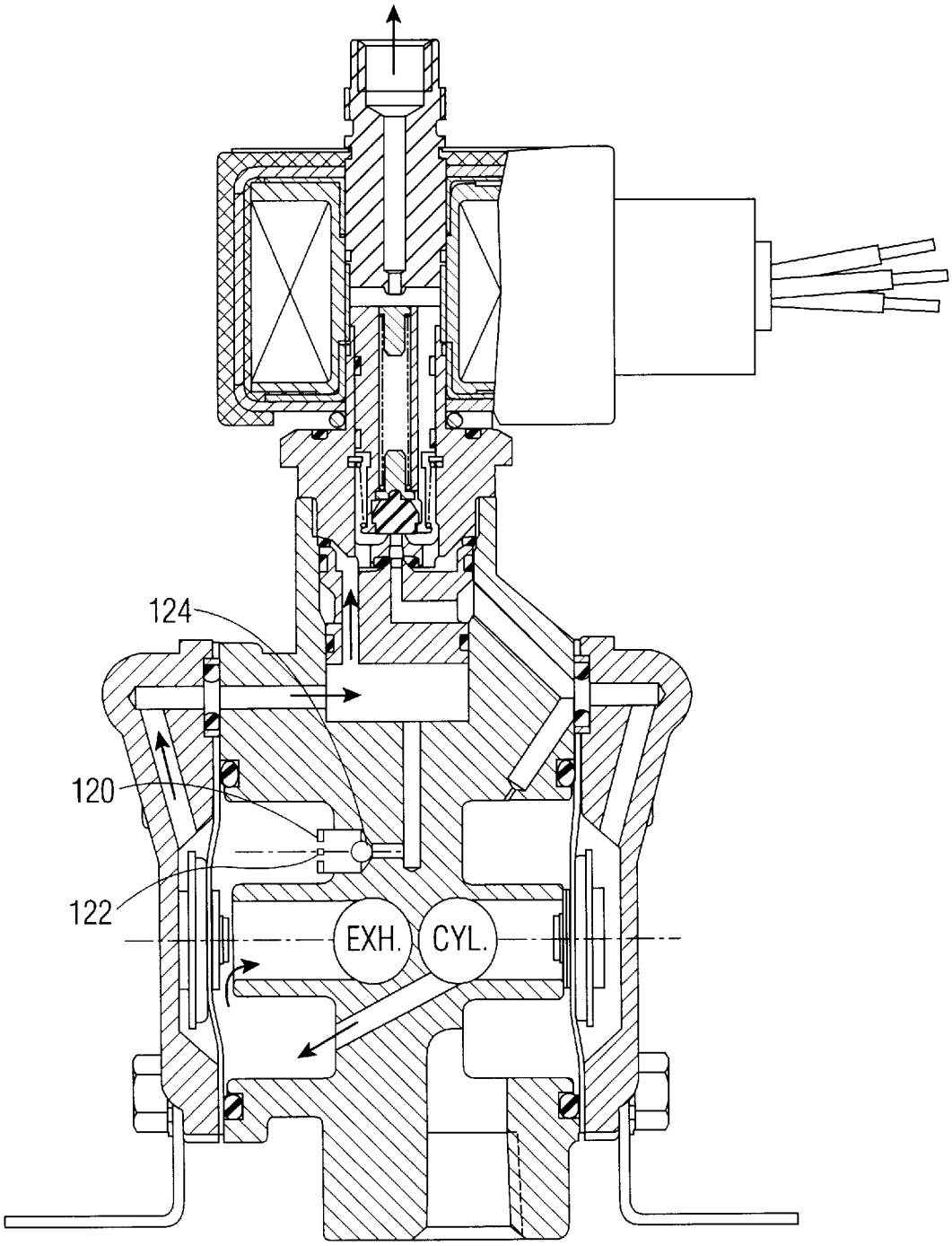
FIG. 7 is a schematic elevation view of a three way valve in accordance with the preferred embodiment of the invention in a third stage of operation.

Referring now to FIGS. 5, 6 and 7, in order to avoid premature closure of the main pressure valve 25 and inability to operate the exhaust valve 39 inherent in prior art three-way valves of the type heretofore described, a check valve 120 is disposed in the exhaust bleed opening 105 to prevent air flow from the working chamber to the space behind the exhaust main valve member 45 and to the ambient atmosphere. Hence transfer of pressure from working chamber 5 to the region behind the main pressure valve member 29 can only occur through the main pressure valve bleed opening 73. That is, air in the working chamber 5 can not bypass the pressure valve bleed opening 73 and reach the region behind the main valve member directly through the conduit 81.

In FIG. 5, the solenoid is deenergized so that inlet air is essentially confined to the space behind the main pressure valve member 29 and the pressure chamber 9. The check valve 120 in the exhaust bleed port 105 has an inlet 122 in communication with the working chamber 5 and an outlet 124 in communication with the space behind the exhaust valve member 45 and the space 114 surrounding the pilot exhaust opening 93. FIG. 5 corresponds to FIG. 1 except for the inclusion of the check valve 120 in the former.

When the solenoid 69 is energized, air trapped behind the main pressure valve member 29 enters the space behind the main exhaust valve member 45 and the main valve 25 is forced open, thereby allowing pressurized air in the pressure chamber 9 to fill the working chamber 5. Once equilibrium between the pressures in the working chamber 5 and pressure chamber 9 is reached, the main pressure valve member 29 returns to its rest position on the main pressure valve seat 7 as shown in FIG. 6. If there is now a sudden drop in pressure at the inlet port 13 so that pressure in the working chamber 5 exceeds pressure in the pressure chamber 9, the check valve 120 will inhibit the flow of air in the working chamber 5 from entering the space behind main pressure valve member 29 faster than it can enter pressure chamber 9, and valve lock-up is thereby prevented.

When the solenoid 69 is again deenergized, as shown in FIG. 7, air in the space behind exhaust valve member 45 enters the ambient atmosphere through passages 118, 116, 108, the space 114 surrounding pilot member 57, and pilot exhaust opening 93. The check valve 120 prevents air in the working chamber 5 from entering the space behind exhaust valve member 45 and preventing the exhaust valve member 45 from opening.

It is to be appreciated that the foregoing is a description of a preferred embodiment of the invention to which variations and modifications may be made without departing from the spirit and scope of the invention.

What is claimed is:

1. In a three-way valve comprising a working chamber having an inlet port, an exhaust port and a work port, a pressure chamber having an inlet port adapted to be connected to a source of pressure, and an outlet port, a main pressure valve seat circumscribing a main pressure valve opening at an interface between said work chamber inlet port and main pressure valve outlet port, a main pressure valve member movable in response to differences in force exerted on a front side thereof by the pressure in said work chamber and in said pressure chamber, and on a rear side thereof by the pressure in a space behind said main pressure valve member for seating on and unseating from said main pressure valve seat, a bleed passageway between said pressure chamber and said space behind said main pressure valve member, an exhaust chamber having an inlet port, and an outlet port adapted to open into the ambient atmosphere, an main exhaust valve seat circumscribing an main exhaust valve opening at an interface between said work chamber outlet port and main exhaust valve inlet port, an main exhaust valve member movable in response to differences in force exerted on a front side thereof by the pressure in said work chamber and in said exhaust chamber, and on a rear side thereof by the pressure in a space behind said main exhaust valve member for seating on and unseating from said main exhaust valve seat, a bleed passageway between said work chamber and said space behind said main exhaust valve member, a pilot pressure valve seat circumscribing a pilot pressure valve opening at an interface between said space behind said main pressure valve member and said space behind said main exhaust valve member, a pilot exhaust valve seat circumscribing a pilot exhaust valve opening at an interface between said space behind said main exhaust valve member and the ambient atmosphere, and pilot valve means having an off state for sealing said pilot pressure valve opening while exposing said exhaust pressure valve opening, and an on state for sealing said exhaust pressure valve opening while exposing said pilot pressure valve opening, the improvement comprising unidirectional flow means mounted between said working chamber and said space behind the main exhaust valve member for preventing flow of fluid from the working chamber to the space behind the main exhaust valve member through the exhaust bleed passageway but permitting flow of fluid from the space behind the main exhaust valve member to the working chamber through the exhaust bleed passageway.

2. A three-way valve according to claim 1 wherein said unidirectional flow means is disposed between said working chamber and said exhaust bleed passageway.

3. A three-way valve according to claim 1 wherein said unidirectional flow means is disposed between said space behind the main exhaust valve member and at least a portion of said exhaust bleed passageway.

4. A three-way valve according to claim 1 wherein said unidirectional flow means is disposed within at least a portion of said exhaust bleed passageway.

5. A three-way valve according to claim 1 wherein said unidirectional flow means comprises a check valve.

* * * * *